US011221172B2

(12) United States Patent
Kabumoto et al.

(10) Patent No.: US 11,221,172 B2
(45) Date of Patent: Jan. 11, 2022

(54) HEAT INSULATION BOX MANUFACTURING METHOD AND HEAT INSULATION BOX

(71) Applicant: PHC HOLDINGS CORPORATION, Tokyo (JP)

(72) Inventors: Takanari Kabumoto, Ehime (JP); Kenichi Mizumoto, Gunma (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 482 days.

(21) Appl. No.: 16/241,082

(22) Filed: Jan. 7, 2019

(65) Prior Publication Data

US 2019/0137164 A1 May 9, 2019

Related U.S. Application Data

(63) Continuation of application No. PCT/JP2017/023383, filed on Jun. 26, 2017.

(30) Foreign Application Priority Data

Jul. 8, 2016 (JP) ..... JP2016-135697

(51) Int. Cl.
*F25D 11/04* (2006.01)
*F25D 23/08* (2006.01)
(Continued)

(52) U.S. Cl.
CPC ..... *F25D 11/04* (2013.01); *F25D 11/00* (2013.01); *F25D 23/02* (2013.01); *F25D 23/064* (2013.01);
(Continued)

(58) Field of Classification Search
CPC ..... F25D 11/04; F25D 11/00; F25D 23/064; F25D 23/02; F25D 23/08; F25B 7/00
See application file for complete search history.

(56) References Cited

U.S. PATENT DOCUMENTS 4,298,947 A * 11/1981 Tamura ..... F25D 29/005 374/170
2001/0003383 A1* 6/2001 Miyake ..... B29C 51/002 264/173.19

FOREIGN PATENT DOCUMENTS

CN 1896654 A 1/2007
JP S47-21749 Y1 7/1972
(Continued)

OTHER PUBLICATIONS

Extended European Search Report dated Jun. 3, 2019 for the corresponding European Patent Application No. 17824052.9.
(Continued)

*Primary Examiner* — Emmanuel E Duke
(74) *Attorney, Agent, or Firm* — McDermott Will and Emery LLP

(57) ABSTRACT

A method for manufacturing a heat insulation box, wherein said method involves disposing an outer box over the outside of an inner box such that there is space therebetween, covering an opening with an elastic sheet from the outside of the outer box, inserting a jig into the opening from the outside of the outer box to force the elastic sheet into the space between the inner box and the outer box, and injecting the urethane foam heat insulating material into the space between the inner box and the outer box so as to foam therein to form a recess with the elastic sheet tightly adhering to the surface thereof.

6 Claims, 4 Drawing Sheets

(51) Int. Cl.

| | |
|---|---|
| ***F25D 11/00*** | (2006.01) |
| ***F25D 23/06*** | (2006.01) |
| ***F25D 23/02*** | (2006.01) |
| *F25B 7/00* | (2006.01) |

(52) U.S. Cl.
CPC ..... *F25D 23/08* (2013.01); *F25B 7/00* (2013.01); *F25D 2331/804* (2013.01)

(56) References Cited

FOREIGN PATENT DOCUMENTS

| | | | | |
|---|---|---|---|---|
| JP | S48-055445 | A | | 8/1973 |
| JP | 49046813 | B | * | 12/1974 |
| JP | S49-046813 | B1 | | 12/1974 |
| JP | S53-016956 | A | | 2/1978 |
| JP | 61084213 | A | * | 4/1986 |
| JP | S63-078889 | U | | 5/1988 |
| JP | H09-072651 | A | | 3/1997 |
| JP | 2000-105047 | A | | 4/2000 |
| JP | 2000105047 | A | * | 4/2000 |

OTHER PUBLICATIONS

International Search Report issued in International Application No. PCT/JP2017/023383 dated Sep. 12, 2017 (with English translation).

* cited by examiner

HEAT INSULATION BOX MANUFACTURING METHOD AND HEAT INSULATION BOX

CROSS REFERENCE

This application is the Continuation Application of International Application No. PCT/JP2017/023383 filed on Jun. 26, 2017, which claims the benefit of Japanese Application No. 2016-135697 filed on Jul. 8, 2016, the entire contents of each are hereby incorporated by reference.

TECHNICAL FIELD

The present invention relates to a method for manufacturing a heat insulation box and a heat insulation box.

BACKGROUND ART

Conventionally, a binary freezing apparatus has been known as an ultracold freezing apparatus for storing cells, microorganisms, and the like. PTL 1 discloses a binary freezing apparatus in which a cascade capacitor is incorporated in a recessed portion provided on a back surface of a heat insulation box.

In a case where the recessed portion is formed on the back surface of the heat insulation box, a tray processed by vacuum forming is disposed in an opening of an outer box, and urethane foam is injected into a space between an inner box and the outer box to fill the space by foaming. At this time, the urethane foam is injected in such a state where the tray is fixed with a jig to prevent the tray from being deformed by foaming pressure of the urethane foam injected into the space between the inner box and the outer box.

CITATION LIST

Patent Literature

PTL 1
Japanese Patent Application Laid-Open No. 2000-105047

SUMMARY OF INVENTION

Technical Problem

However, in the case where the tray processed by the vacuum forming is used to form the recessed portion of the heat insulation box, a vacuum molding die is required to manufacture the tray, and a new die is required at each time a shape of the tray is changed. In addition, since the tray is not flexible, a gap tends to be generated between the tray and the outer box when the tray is disposed in the opening of the outer box. Therefore, it has been necessary to dispose a sealing material on the side of the tray between the outer box and the tray so that the urethane foam does not leak from the gap. As a result, productivity may be lowered in some cases. Furthermore, since the tray produced by the vacuum forming may crack at times due to shrinkage caused by heat change, condensation caused by heat change of the cascade capacitor adheres to the urethane foam through a crack, thereby lowering heat insulation performance.

An object of the present invention is to provide a method for manufacturing a heat insulation box without using a tray and a heat insulation box.

Solution to Problem

A method for manufacturing a heat insulation box according to the present invention includes an inner box that stores an article therein, an outer box that includes an opening, and a foamed material that fills a space between the inner box and the outer box by foaming and includes a recessed portion in the opening of the outer box, the method including: disposing the outer box outside the inner box with a space interposed therebetween; covering the opening from outside of the outer box with an elastic sheet; inserting a jig having a projected portion corresponding to the recessed portion from the outside of the outer box into the opening and pushing the elastic sheet into the space between the inner box and the outer box with the projected portion; and injecting the foamed material into the space between the inner box and the outer box and foaming the foamed material to form the recessed portion with the elastic sheet in close contact with a surface of the recessed portion.

A heat insulation box according to the present invention includes: an inner box that stores an article therein; an outer box that includes an opening; a foamed material that fills a space between the inner box and the outer box by foaming and includes a recessed portion in the opening of the outer box; and an elastic sheet disposed in close contact with a surface of the recessed portion.

Advantageous Effects of Invention

According to the present invention, a heat insulation box can be manufactured without using a tray. Accordingly, productivity can be improved. In addition, deterioration of urethane foam due to condensation can be prevented and heat insulation performance can be maintained.

DESCRIPTION OF EMBODIMENTS

Hereinafter, an embodiment of the present invention will be described in detail with reference to the accompanying drawings. Note that the embodiment to be described below is an example, and the present invention is not limited by this embodiment.

Figure 1:
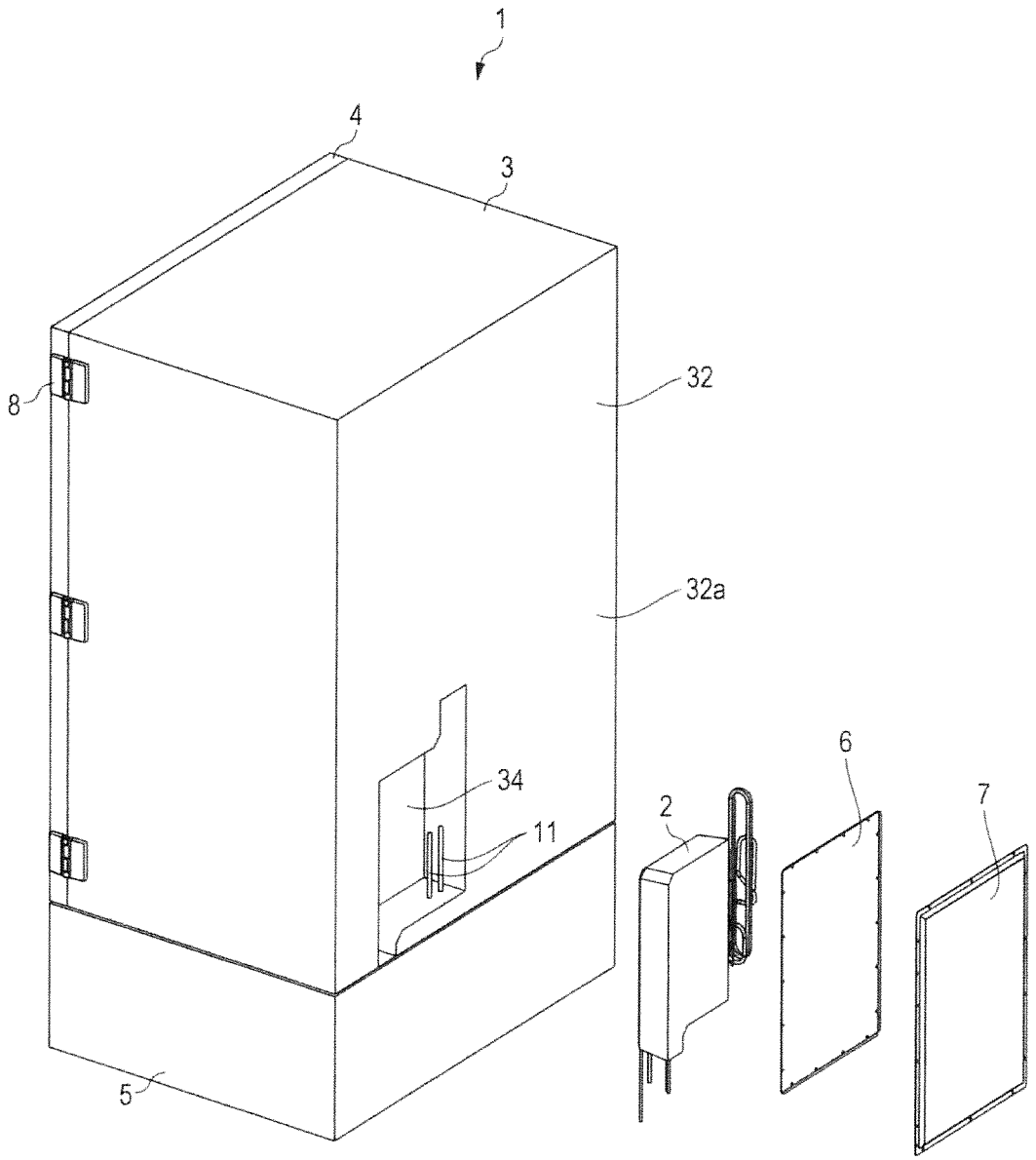
FIG. 1 is an overall configuration diagram of a binary freezing apparatus.

FIG. 1 is an overall configuration diagram of binary freezing apparatus 1. Note that FIG. 1 illustrates a state before cascade capacitor 2 is incorporated. Binary freezing apparatus 1 includes main body 3 having a front opening, front door 4 provided on the front opening of main body 3 to be openable, and machine room 5 provided beneath main body 3.

Main body 3 includes inner box 31 (to be described later, see FIG. 2) made of an iron plate having a front opening, outer box 32 made of an iron plate having a front opening, which is disposed outside inner box 31 to be spaced apart therefrom, and foamed urethane insulating material 33 (to be described later, see FIG. 2) as a heat insulating material filling a space between inner box 31 and outer box 32 by foaming.

As illustrated in FIG. 1, recessed portion 34 is formed on the back surface of main body 3. Cascade capacitor 2 for performing heat exchange between a high-temperature side refrigerant circuit and a low-temperature side refrigerant circuit is incorporated in recessed portion 34.

As illustrated in FIG. 1, a main body portion of cascade capacitor 2 is surrounded by urethane foam as a heat insulating material, and is formed in a substantially rectangular parallelepiped shape. After cascade capacitor 2 is disposed in recessed portion 34 on the back surface of main body 3, first back panel 6 made of an iron plate is fixed to back surface 32*a* of outer box 32 (hereinafter referred to as "outer box back surface") using a screw (not illustrated).

Further, second back panel 7 formed by urethane foam as a heat insulating material being surrounded by an iron plate is fixed to the back surface of first back panel 6 using a screw (not illustrated). In this manner, cascade capacitor 2 is incorporated in main body 3.

As illustrated in FIG. 1, front door 4 is fixed to the front surface of outer box 32 to be openable using hinge 8. In the present embodiment, hinges 8 are fixed at three positions on a side surface of outer box 32. Front door 4 is formed by urethane foam as a heat insulating material being surrounded by an iron plate.

As illustrated in FIG. 1, machine room 5 is disposed to support the entire bottom surface of outer box 32, and functions as a base of main body 3. In machine room 5, there are disposed a compressor forming a part of the high-temperature side refrigerant circuit and the low-temperature side refrigerant circuit, a condenser, and the like.

Figure 2:
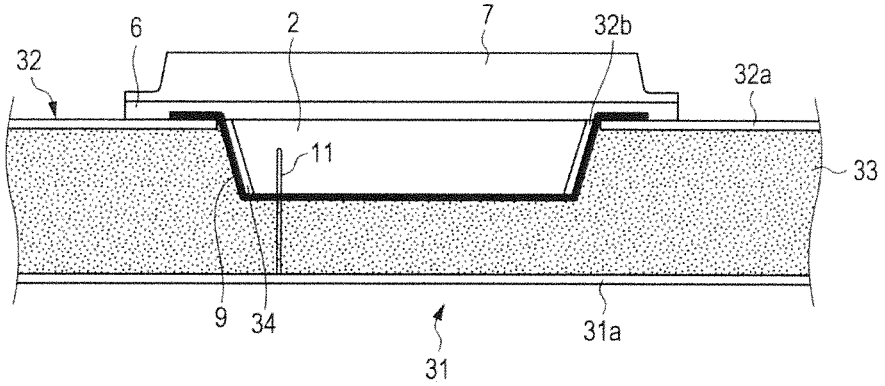
FIG. 2 is a cross-sectional view illustrating a recessed portion in which a cascade capacitor is disposed.

FIG. 2 is a cross-sectional view illustrating recessed portion 34 in a state where cascade capacitor 2 is incorporated. As illustrated in FIG. 2, recessed portion 34 is formed on foamed urethane insulating material 33 filling a space between back surface 31*a* of inner box 31 (hereinafter referred to as "inner box back surface") and outer box back surface 32*a* by foaming at opening 32*b* of outer box back surface 32*a*.

Elastic sheet 9 made of polyurethane elastomer is closely fixed to the surface of recessed portion 34 of foamed urethane insulating material 33. Elastic sheet 9 is flexible and stretch, and prevents permeation of liquid such as water. Elastic sheet 9 is a sheet having flexibility and stretch even at a low temperature of −90° C. A thickness of elastic sheet 9 is 0.05 mm, for example.

Figure 3A:
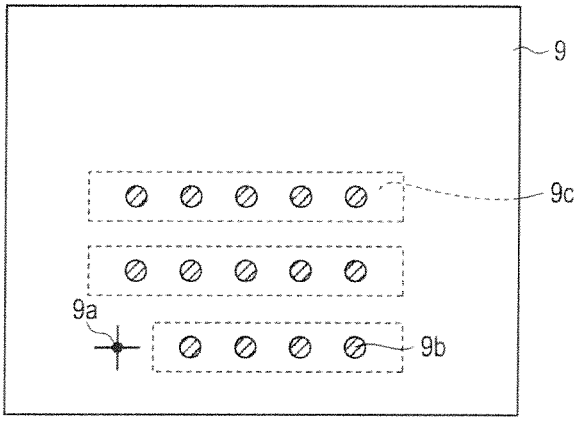
FIG. 3A is a top view illustrating an elastic sheet.

Here, elastic sheet 9 will be described with reference to FIG. 3A. FIG. 3A is a top view illustrating elastic sheet 9 before being assembled. As illustrated in FIG. 3A, elastic sheet 9 is rectangular, and positioning hole 9*a* is provided at the lower left part in FIG. 3A. Further, as illustrated in FIG. 3A, elastic sheet 9 is provided with a plurality of holes 9*b* longitudinally and laterally aligned separately from positioning hole 9*a*.

Furthermore, mesh sheet 9*c* is attached to hole 9*b*. In the example illustrated in FIG. 3A, the plurality of holes 9*b* aligned in the lateral direction is blocked by one mesh sheet 9*c*. A mesh size in mesh sheet 9*c* is preferably a size in which permeation of gas such as air is possible and permeation of liquid such as water is prevented. With this arrangement, air bleeding using hole 9*b* can be performed during foaming of the urethane foam to be described later, and a function of preventing permeation of liquid such as water in elastic sheet 9 is secured.

As illustrated in FIG. 2, cascade capacitor 2 is disposed in recessed portion 34 in which elastic sheet 9 is fixed on the surface thereof. First back panel 6 and second back panel 7 are fixed to outer box back surface 32*a*, whereby cascade capacitor 2 is prevented from dropping off from recessed portion 34 and is blocked from outside air.

As illustrated in FIG. 2, an edge portion of elastic sheet 9 extends on the surface of outer box back surface 32*a* to surround opening 32*b* via a sealing material (not illustrated). By first back panel 6 being fixed to outer box back surface 32*a*, the edge portion of elastic sheet 9 is sandwiched between outer box back surface 32*a* and first back panel 6. Accordingly, the space in which cascade capacitor 2 is disposed is hermetically sealed.

With first back panel 6 being fixed to outer box back surface 32*a*, cascade capacitor 2 is in close contact with the bottom of recessed portion 34 and first back panel 6. In addition, a shape of a side surface of cascade capacitor 2 is a shape that follows a side surface of recessed portion 34. Accordingly, there is almost no gap between cascade capacitor 2 and recessed portion 34, thereby suppressing condensation.

Figure 3B:
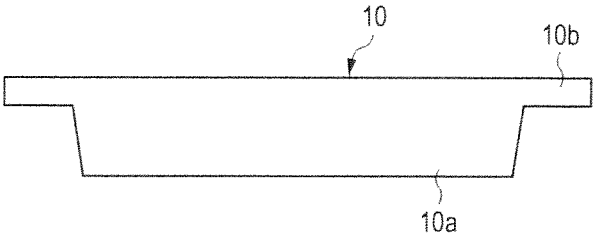
FIG. 3B is a cross-sectional view illustrating a jig.

FIG. 3B is a cross-sectional view illustrating a jig used for forming the recessed portion according to the present embodiment. As illustrated in FIG. 3B, jig 10 includes insertion portion 10*a*, and flange portion 10*b*.

The proximal end side of insertion portion 10*a* has a shape substantially the same as opening 32*b* of outer box back surface 32*a* (see FIG. 2). Insertion portion 10*a* has a tapered shape in which the distal end side is narrower than the proximal end side. The taper angle of insertion portion 10*a* from the proximal end side toward the distal end side is 10°, for example. Flange portion 10*b* protrudes from the side surface on the proximal end side of insertion portion 10*a*, and the surface area on the back surface side of flange portion 10*b* is larger than the opening area of opening 32*b* of outer box back surface 32*a*.

Figure 4:
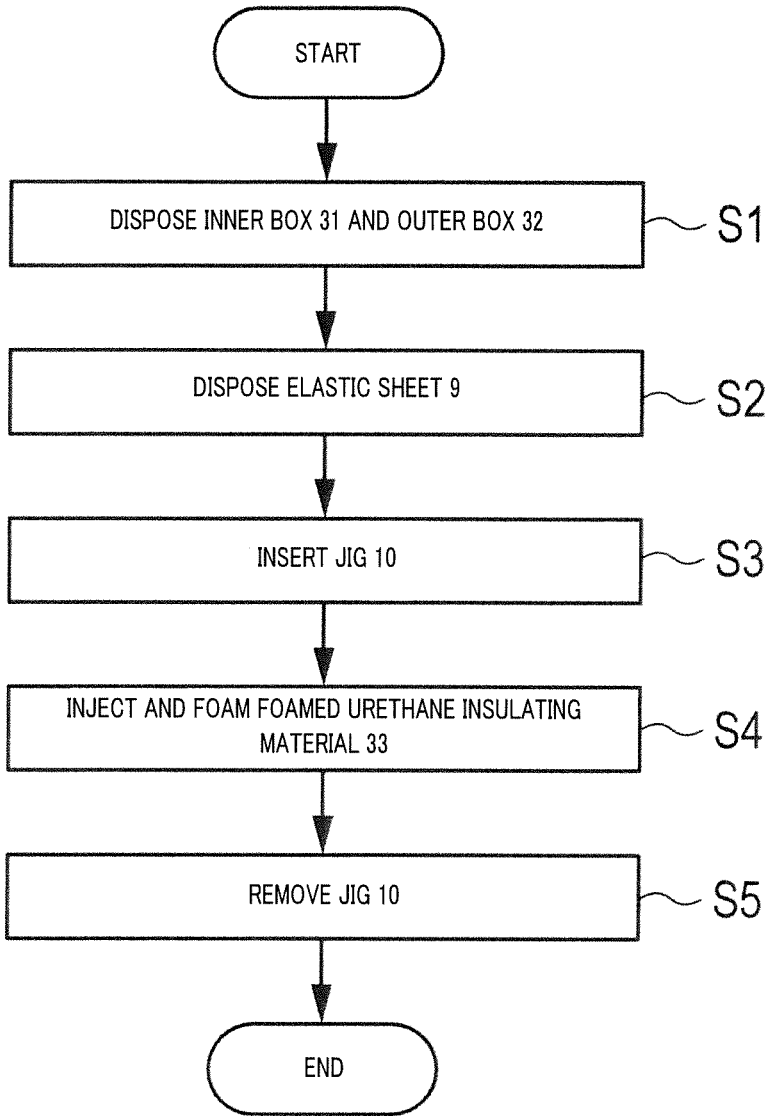
FIG. 4 is a flowchart illustrating a method for forming the recessed portion.

Next, a method for forming recessed portion 34 according to the present embodiment will be described with reference to FIGS. 4 and 5A to 5E. FIG. 4 is a flowchart illustrating the method for forming recessed portion 34. FIGS. 5A to 5E are cross-sectional views illustrating respective steps of forming recessed portion 34.

Figure 5A:
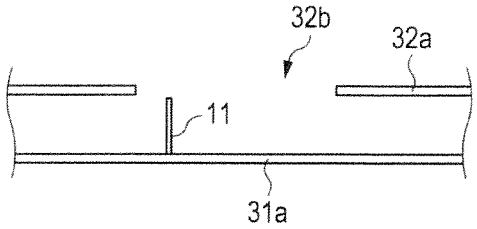
FIG. 5A is a cross-sectional view illustrating a step of forming the recessed portion.

In step S1, outer box 32 is disposed outside inner box 31 to be spaced apart from inner box 31. Specifically, as illustrated in FIG. 5A, outer box back surface 32*a* including opening 32*b* is disposed on the back surface side of inner box back surface 31*a* with a space of 70 mm, for example, interposed therebetween. At this time, as illustrated in FIG. 5A, connection pipe 11 for connection with cascade capacitor 2 protrudes from inner box back surface 31*a* toward the back surface side.

Figure 5B:
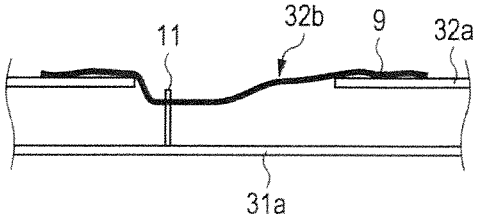
FIG. 5B is another cross-sectional view illustrating the step of forming the recessed portion.

In step S2, elastic sheet 9 is placed to cover opening 32*b* from the back surface side of outer box back surface 32*a* (FIG. 5B). At this time, as described above, connection pipe 11 protrudes from inner box back surface 31*a* toward the back surface side, and positioning hole 9*a* provided on elastic sheet 9 is inserted into connection pipe 11, thereby performing positioning of elastic sheet 9 with respect to opening 32*b*.

Note that a low-friction tape may be attached to the back surface side of elastic sheet 9. Accordingly, the jig can be smoothly removed in step S5 to be described later.

Figure 5C:
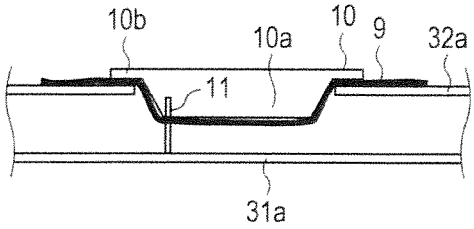
FIG. 5C is another cross-sectional view illustrating the step of forming the recessed portion.

In step S3, jig 10 is inserted into opening 32*b* from the back surface side of outer box back surface 32*a* (FIG. 5C). Specifically, insertion portion 10*a* of jig 10 is inserted into opening 32*b* from the back surface side of outer box back surface 32*a*, and flange portion 10*b* of jig 10 is brought into contact with outer box back surface 32*a* via elastic sheet 9.

At this time, connection pipe 11 is inserted into a through hole (not illustrated) provided in jig 10. Accordingly, as illustrated in FIG. 5C, elastic sheet 9 is pushed into the space between inner box back surface 31*a* and outer box back surface 32*a* by insertion portion 10*a* of jig 10.

In the present embodiment, prior to the insertion of jig 10, a sealing material such as a sponge is disposed on outer box back surface 32*a* to surround opening 32*b* on the side of outer box back surface 32*a*. With this arrangement, leakage of the urethane foam from the gap between outer box back surface 32*a* and jig 10 can be suppressed at the time of foaming in step S4 to be described later.

Note that the sealing material may not be disposed as long as contact between flange portion 10*b* of jig 10 and outer box back surface 32*a* can be secured.

In step S4, the urethane foam is injected into the space between inner box back surface 31*a* and outer box back surface 32*a*, and is foamed. Here, since elastic sheet 9 is flexible as described above, elastic sheet 9 deforms along the surface of insertion portion 10*a* of jig 10 by foaming pressure of the urethane foam.

Figure 5D:
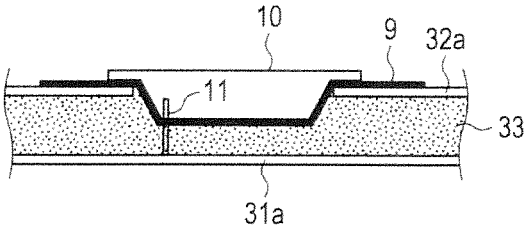
FIG. 5D is another cross-sectional view illustrating the step of forming the recessed portion.

With the foaming of the urethane foam, the air in the space between inner box back surface 31*a* and outer box back surface 32*a* is discharged from an air-bleeding hole (not illustrated) provided in outer box back surface 32*a*. FIG. 5D illustrates an appearance of the urethane foam after foaming.

Figure 5E:
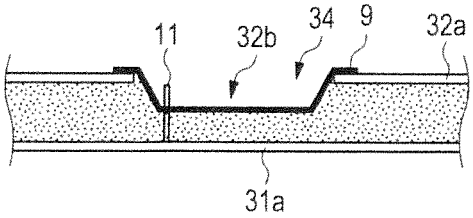
FIG. 5E is another cross-sectional view illustrating the step of forming the recessed portion.

In step S5, jig 10 is removed, and an unnecessary portion of the edge portion of elastic sheet 9 extending to the back surface side of outer box back surface 32*a* is cut off (FIG. 5E). Accordingly, recessed portion 34 is formed in opening 32*b* in a state where elastic sheet 9 is in close contact.

Subsequently, cascade capacitor 2 is disposed in recessed portion 34 formed by the method described above. At this time, connection pipe 11 protruding from inner box back surface 31*a* is connected to cascade capacitor 2.

As described above, according to the present embodiment, outer box 32 is disposed outside inner box 31 to be spaced apart therefrom, opening 32*b* of outer box 32 is covered with elastic sheet 9 from the outside of outer box 32, jig 10 is inserted into opening 32*b* from the outside of outer box 32 so that elastic sheet 9 is pushed into the space between inner box 31 and outer box 32, and foamed urethane insulating material 33 is injected into the space between inner box 31 and outer box 32 and is foamed to be in close contact with elastic sheet 9, whereby a heat insulation box can be manufactured without using a tray processed by vacuum forming. Accordingly, productivity can be improved.

Moreover, since elastic sheet 9 having flexibility and stretch, which prevents permeation of liquid such as water, is in close contact with foamed urethane insulating material 33, the following effects can be exerted.

Since elastic sheet 9 prevents permeation of liquid such as water, when binary freezing apparatus 1 is used, it is possible to prevent water due to condensation caused by a temperature of cascade capacitor 2 being lowered from penetrating through foamed urethane insulating material 33. Accordingly, hydrolysis of foamed urethane insulating material 33 can be suppressed, and favorable heat insulation performance can be continuously obtained.

Furthermore, since elastic sheet 9 is not cracked due to shrinkage or the like caused by heat change, it is possible to prevent condensation caused by heat change of the cascade capacitor from adhering to the urethane foam through a crack, and is possible to prevent heat insulation performance from being lowered.

Since elastic sheet 9 is flexible and stretch, it can be easily deformed. Therefore, at the time of screwing first back panel 6 onto outer box back surface 32*a* while cascade capacitor 2 is being pushed, foamed urethane insulating material 33 and elastic sheet 9 deform to follow the shape of cascade capacitor 2 at the contact surface with cascade capacitor 2. As a result, the gap between cascade capacitor 2 and recessed portion 34 can be eliminated, whereby condensation in recessed portion 34 can be suppressed.

Note that, although the exemplary case where cascade capacitor 2 is disposed in recessed portion 34 has been described in the present embodiment, it is not limited thereto. For example, electrical components for controlling the apparatus may be disposed in recessed portion 34.

Further, although the exemplary case of the heat insulation box in the binary freezing apparatus has been described in the present embodiment, it is not limited thereto. The heat insulation box according to the present invention can be applied to various uses utilized for storing articles while conserving heat, such as a refrigerator and a cooling box.

Furthermore, although the exemplary case of elastic sheet 9 made of polyurethane elastomer has been described in the present embodiment, it is not limited thereto. The sheet to be used only needs to be flexible and stretch, prevent permeation of liquid such as water, and have flexibility and stretch with respect to a temperature reached by members disposed in recessed portion 34 such as cascade capacitor 2.

The present application claims priority based on Japanese Patent Application No. 2016-135697 filed on Jul. 8, 2016 at Japan Patent Office. The contents of Japanese Patent Application No. 2016-135697 are incorporated into the present application by reference.

INDUSTRIAL APPLICABILITY

The method for manufacturing the heat insulation box and the heat insulation box according to the present disclosure are suitable for application to a binary freezing apparatus.

REFERENCE SIGNS LIST

1 Binary freezing apparatus
2 Cascade capacitor
3 Main body
31 Inner box
31*a* Inner box back surface
32 Outer box
32*a* Outer box back surface
32*b* Opening
33 Foamed urethane insulating material
34 Recessed portion
4 Front door
5 Machine room
6 First back panel
7 Second back panel
8 Hinge
9 Elastic sheet
9*a* Positioning hole
9*b* Hole
9*c* Mesh sheet
10 Jig

10*a* Insertion portion
10*b* Flange portion
11 Connection pipe

The invention claimed is:

1. A method for manufacturing a heat insulation box including an inner box that stores an article therein, an outer box that includes an opening, and a foamed material that fills a space between the inner box and the outer box by foaming and includes a recessed portion in the opening of the outer box, the method comprising:

disposing the outer box outside the inner box with a space interposed therebetween;

covering the opening from outside of the outer box with an elastic sheet;

inserting a jig having a projected portion corresponding to the recessed portion from the outside of the outer box into the opening and pushing the elastic sheet into the space between the inner box and the outer box with the projected portion, the projected portion having a shape of a side surface that follows a side surface of a component to be disposed in the recessed portion; and injecting the foamed material into the space between the inner box and the outer box and foaming the foamed material to form the recessed portion with the elastic sheet in close contact with a surface of the recessed portion, wherein the elastic sheet is provided with a plurality of longitudinally and laterally aligned air-bleeding holes, and the plurality of air-bleeding holes are covered with a mesh sheet.

2. The method for manufacturing the heat insulation box according to claim 1, wherein the elastic sheet is made of polyurethane elastomer.

3. The method for manufacturing the heat insulation box according to claim 1, wherein the heat insulation box is a constituent component of a freezer.

4. The method for manufacturing a heat insulation box according to claim 1, wherein a positioning hole is provided in the elastic sheet while a positioning protrusion is provided on a back surface of the inner box, and the positioning hole is inserted into the positioning protrusion to perform positioning of the elastic sheet with respect to the opening.

5. A heat insulation box, comprising:

an inner box that stores an article therein;

an outer box that includes an opening;

a foamed material that fills a space between the inner box and the outer box by foaming and includes a recessed portion in the opening of the outer box; and an elastic sheet disposed in close contact with a surface of the recessed portion, wherein a shape of a side surface of the recessed portion is a shape that follows a side surface of a component to be disposed in the recessed portion, wherein the elastic sheet is provided with a plurality of longitudinally and laterally aligned air-bleeding holes, and the plurality of air-bleeding holes are covered with a mesh sheet.

6. A freezer, comprising:

the heat insulation box according to claim 5, wherein a cascade capacitor is disposed in the recessed portion.

* * * * *